US005381597A

United States Patent [19]

Petrove

[11] Patent Number: 5,381,597

[45] Date of Patent: Jan. 17, 1995

[54] AUTOMATIC ROBOT ROOFER FOR INSTALLATION OF SHINGLES

[76] Inventor: Jesse F. Petrove, 43121 Donley, Sterling Hts., Mich. 48314

[21] Appl. No.: 57,109

[22] Filed: May 4, 1993

[51] Int. Cl.[6] ..... B23Q 15/00

[52] U.S. Cl. ..... 29/714; 29/709; 29/798; 227/111; 52/749

[58] Field of Search ..... 29/798, 709, 714, 771; 227/110, 111; 52/746, 747, 748, 749

[56] References Cited

U.S. PATENT DOCUMENTS

| | | | |
|---|---|---|---|
| 3,173,593 | 3/1965 | Elliott | 227/111 |
| 3,298,584 | 1/1967 | Miller | 227/111 |
| 3,769,916 | 11/1973 | Hogan | 52/749 |
| 3,794,237 | 2/1974 | Hernandez . | |
| 3,972,462 | 8/1976 | Evans et al. . | |
| 3,984,040 | 10/1976 | Fry . | |
| 4,036,422 | 7/1977 | Harvey . | |
| 4,084,738 | 4/1978 | Schneider . | |
| 4,265,387 | 5/1981 | Strouse . | |
| 4,656,808 | 4/1987 | Mansfield . | |
| 4,700,526 | 10/1987 | McGuinness | 52/748 |
| 4,732,307 | 3/1988 | Hubbard et al. . | |
| 4,785,606 | 11/1988 | Burton | 52/749 |
| 4,993,207 | 2/1991 | Burke | 52/749 |
| 5,081,815 | 1/1992 | Carnell . | |
| 5,169,048 | 12/1992 | Himebaugh | 227/111 |
| 5,197,257 | 3/1993 | Nietling | 52/749 |
| 5,205,103 | 4/1993 | Burton | 52/749 |

*Primary Examiner*—Mark Rosenbaum
*Assistant Examiner*—David P. Bryant

[57] ABSTRACT

Shingling apparatus for applying standard manufactured shingles in successive steps to a roof comprises a frame having a wheel assembly with air driven motors which move the apparatus in a vertical motion. A hopper holds the shingles, and a shuffle bar moves across the shingles placing one shingle at a time onto forks. The forks then move down to the roof where the shingle is then placed in the designated area and then fastened to the roof with a pneumatic nail gun. After the shingle has been fastened, the forks pull out from under the shingle and then return to the starting position to retrieve the next shingle to be fastened down. As the forks return the apparatus starts to move towards the top of the roof in a vertical direction. It stops when it reaches a sensed, predetermined destination. The apparatus is attached to nylon belts which are fastened at the top of the roof to a linear motion brace which is fastened across the peak of the roof.

All movements are accomplished through the use of many sensors and a microprocessing system. The apparatus requires very little attention after the initial setup. The operator simply keeps the hopper filled with shingles and the pneumatic guns filled with fasteners.

5 Claims, 14 Drawing Sheets

AUTOMATIC ROBOT ROOFER FOR INSTALLATION OF SHINGLES

BACKGROUND-FILED OF INVENTION

The present invention relates to an Automatic Robot Roofer which applies, fastens, and aligns shingles on a roof moving vertically from the bottom to the peak of the roof.

BACKGROUND-DESCRIPTION OF PRIOR ART

Applying shingles to a roof has, for the most part, been done manually. The most common .way to lay shingles to the roof is to start at the bottom left hand side of a roof and lay one shingle on top of another working towards the top of the roof. The person laying the shingles must manually apply a shingle as he or she is in a sitting, kneeling, or bending position. Said person would then line the shingle up with lines that are chalked on the roof. Next he of she would line up the shingle on top of the previous shingle. Sliding ones hands, feet, and knees across the surface of the shingles damages hands, clothes, and knees. The shingle is also damaged when it is walked or knelt on in hot or cold temperatures. The continuous bending is also very hard on the back. Numerous shingle applying apparatus have been utilized in an attempt to alleviate the rigors of manual roofing. Examples of such apparatus include the following:

U.S. Pat. No. 3,972,462 issued to Evans et.al. teaches a frame supported by wheels for lateral movement across a roof. The frame supports a chute on which a shingle is placed and positioned against a guide bar. The guide bar is aligned in relation to the upper edge of a row of shingles previously connected to the roof. The frame supports a plurality of nail guns which are selectively pivoted to engage the shingle currently positioned to the chute and fasten each shingle to the roof.

U.S. Pat. No. 4,656,808 issued to Mansfield teaches a drum mounted for rotation in a frame. Shingles are placed on the drum, being secured thereon by ridges connected to the drum specially fitted for engagement within rain-grooves typically defined on such shingles. As the drum is rolled forward, the shingle is conveyed thereon to contact the roof. The shingle is gravitationally disengaged from the drum and automatically nailed by a nail gun. The drum may be indexed up the slope of a roof by a pair of hydraulic pistons mounted on the cross-shafts.

U.S. Pat. No. 5,081,815 issued to Joe W. Carnell teaches a frame supported by wheels mechanically applying and securing to a roof in a standing position. Using guide rails mounted from the top of the roof to the mechanical shingler, the machine must be moved mechanically in rows across the roof one row at a time. All the patents mentioned above use mechanical means of movement of these machines across the roof in rows horizontally. Which means the machine must move approximately three feet at a time before it lays its next shingle. This consumes valuable time. Also these inventions do not allow piles of shingles to be stacked on the roof because the vertical tubular rods would get in the way. This minimizes the number of shingles available on the roof at any given time.

SUMMARY OF INVENTION

It is the principal object of the Automatic Robot Roofer to provide apparatus for robotic applying and securing asphalt or fiber-glass shingles to a roof with little to no effort needed on the operator's part.

In support of the principle objective, another object of the Automatic Robot Roofer is to provide apparatus for applying shingles in a horizontal position and applying one shingle on top of another in a vertical movement. This reduces the movement of the Automatic Robot Roofer to approximately four to six inches, cutting down the time it takes to move the machine to the top of the roof.

Still another object of the Automatic Robot Roofer is to use computer technology to apply shingles more evenly and straighter by means of sensors and photo sensors to gauge and move the machine in a vertical direction.

Yet another object of the Automatic Robot Roofer is to provide the most improved automatic system of applying and securing shingles with less human effort, minimizing physical strain caused by roofing. These and other objects and advantages of the Automatic Robot Roofer are accomplished through the use of a microprocessor which is mounted on the Automatic Robot Roofer.

There are two flat nylon straps that hook to the top of the roof on a linear movement bar which lets the Automatic Robot Roofer pull itself off the roof with the use of air motors. The Automatic Robot Roofer suffer bar automatically moves across the shingles in the roofing hopper delivering one shingle at a time to the shingle fore assembly. The shingle fork assembly then senses the presence of a shingle and then lowers the shingle to the roof in a precise position. Then pneumatic guns fasten the shingle in position roof. A sensor signals the shingle fork assembly to pull the fork out from underneath the shingle and reposition itself for the next shingle. As it repositions, the roofing machine starts moving vertically toward the peak of the roof. The sensor stops the Automatic Robot Roofer at its next location, approximately four to six inches. This can be set to any desired distance. The next shingle is automatically dispensed on the shingle fork again. Then the shingle fork assembly returns to the roof. However, this time it shifts over to the left 4, 6, or 8 inches depending on what computer program is being used and what layout is required. When it has reached the required distance, the pneumatic guns fasten the shingle to the roof and the microprocessor tells the another pneumatic gun to fasten next to the last gun. Every other row of shingles must be offset. When the machine reaches the top of the roof it automatically lowers the four horizontal wheels, lifting the machine so it can move horizontally approximately 3 feet depending on the style of shingle. After moving the approximate distance; the wheels are raised and the machine automatically returns to the bottom of the roof to restart another row of shingles. The Automatic Robot Roofer warns when the supply of fasteners in the pneumatic guns or shingles in the hopper are running low, and will stop until refilled and restart it. The Automatic Robot Roofer also has a safety device. If the downward movement of the machine is faster than it should be, the Automatic Robot Roofer microprocessor will energize an air cylinder and drive its end into the roof to hold it there. This device will only activate when the Automatic Robot Roofer is in danger of coming off the roof. The machine requires no electricity. It runs off of 12 volt batteries which are mounted on it, and it uses only air for all movements of the machine.

DRAWING-FIGS. 1 to 7

Figure 2:
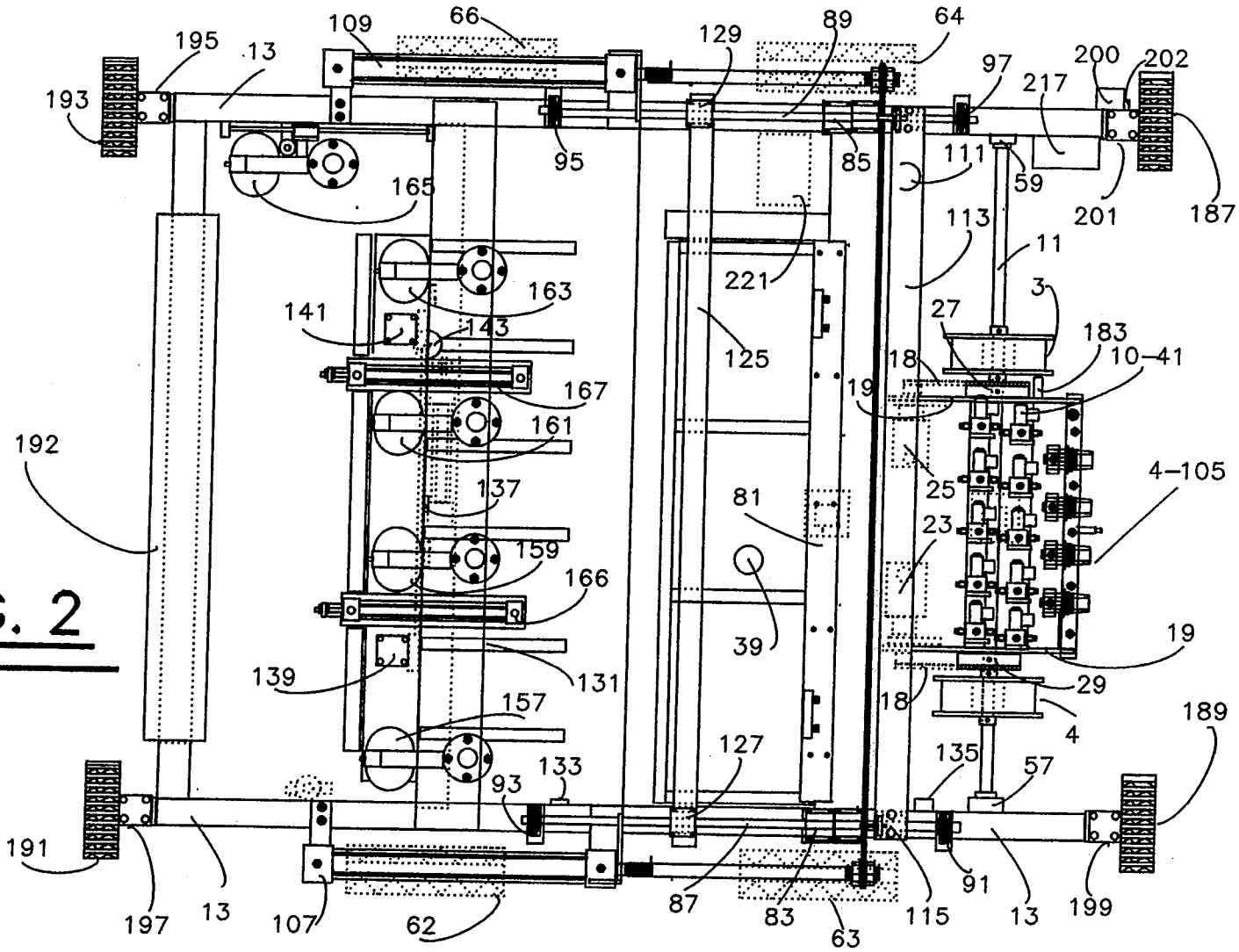
FIG. 2 shows a top view of the Automatic Robot Roofer.
Figure 2A:
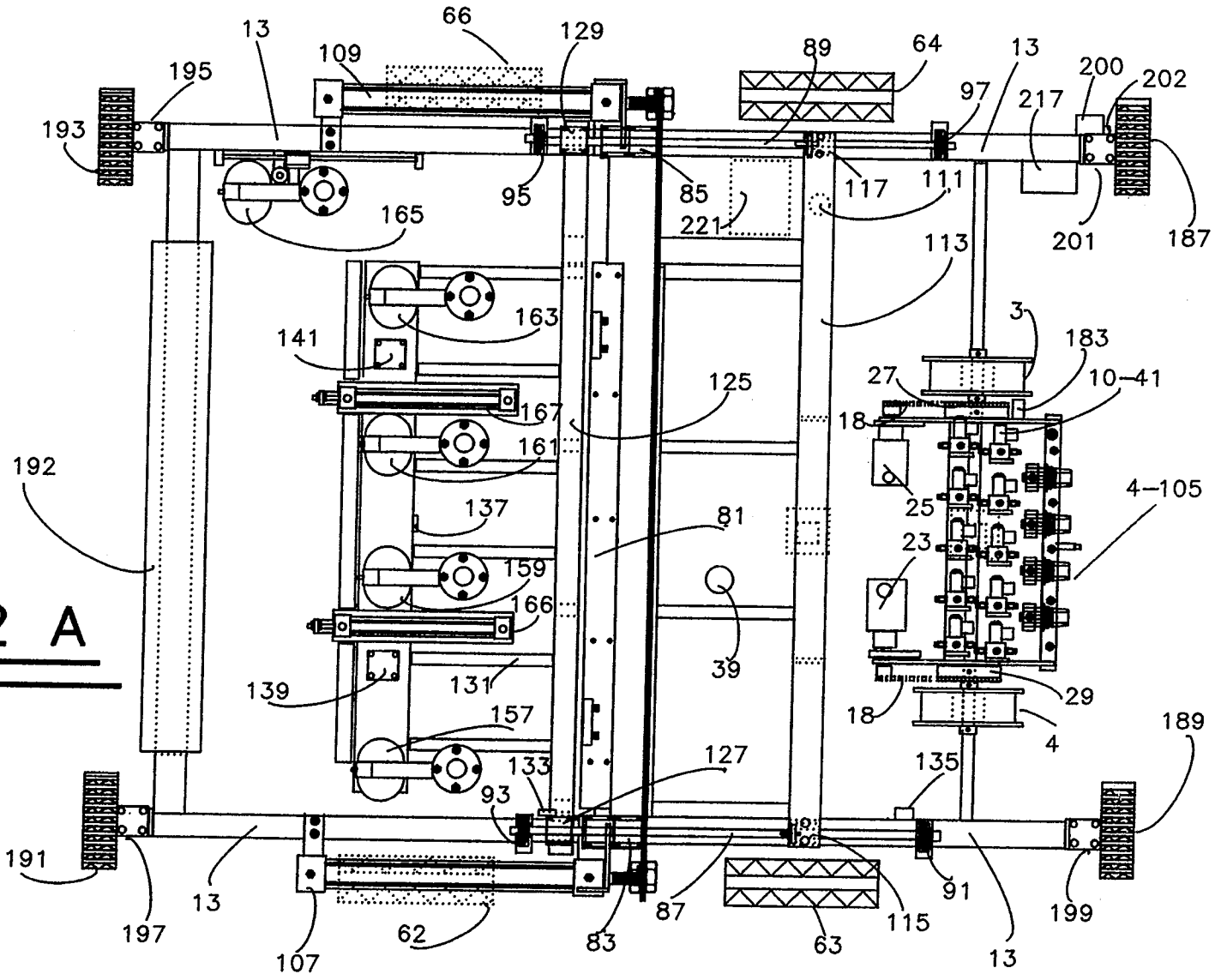

FIG. 2*a* shows a top view when the suffer bar has moved across the hopper.

Figure 2B:
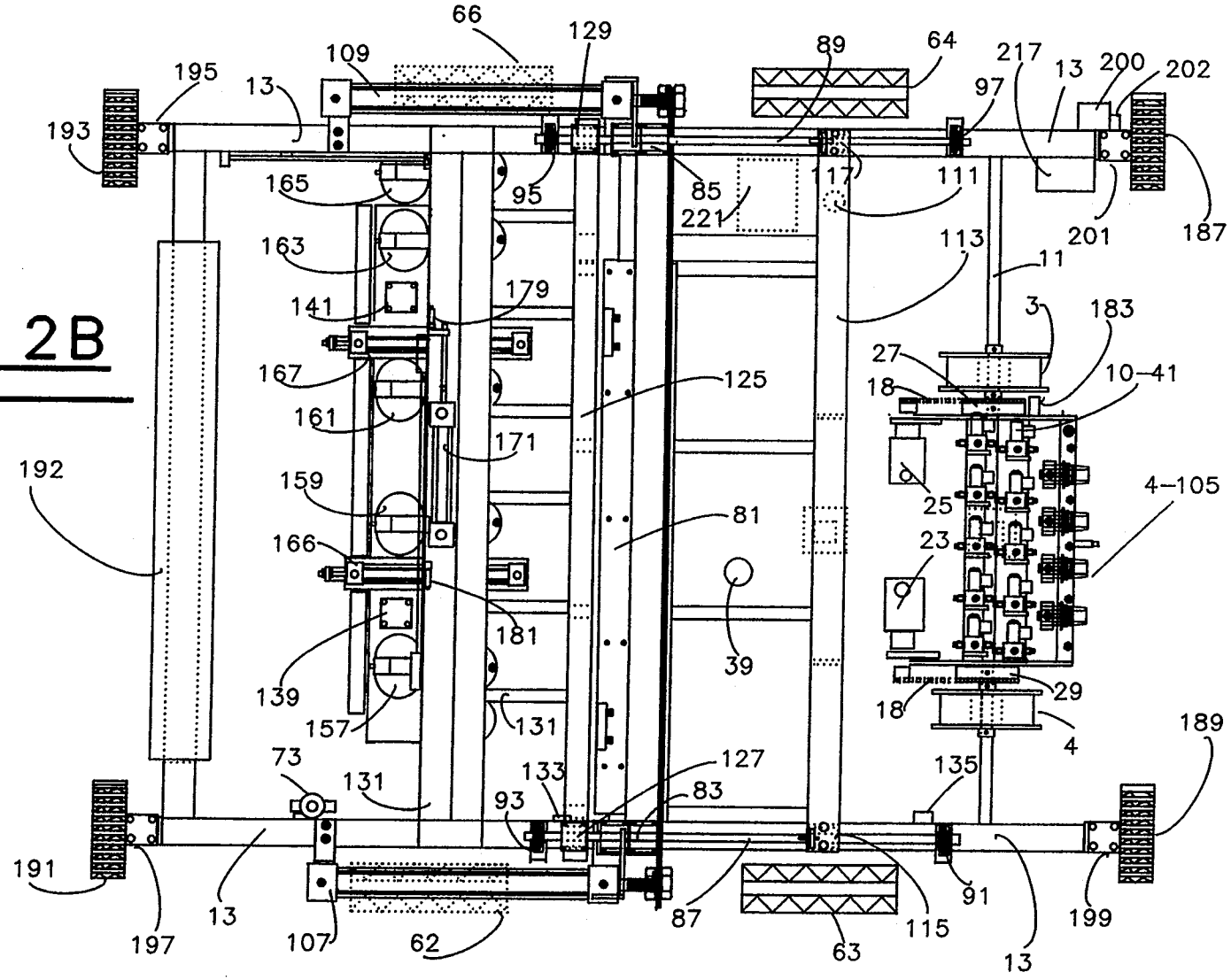

FIG. 2*b* shows top view. Shows movement of the shingle forks to left.

Figure 2C:
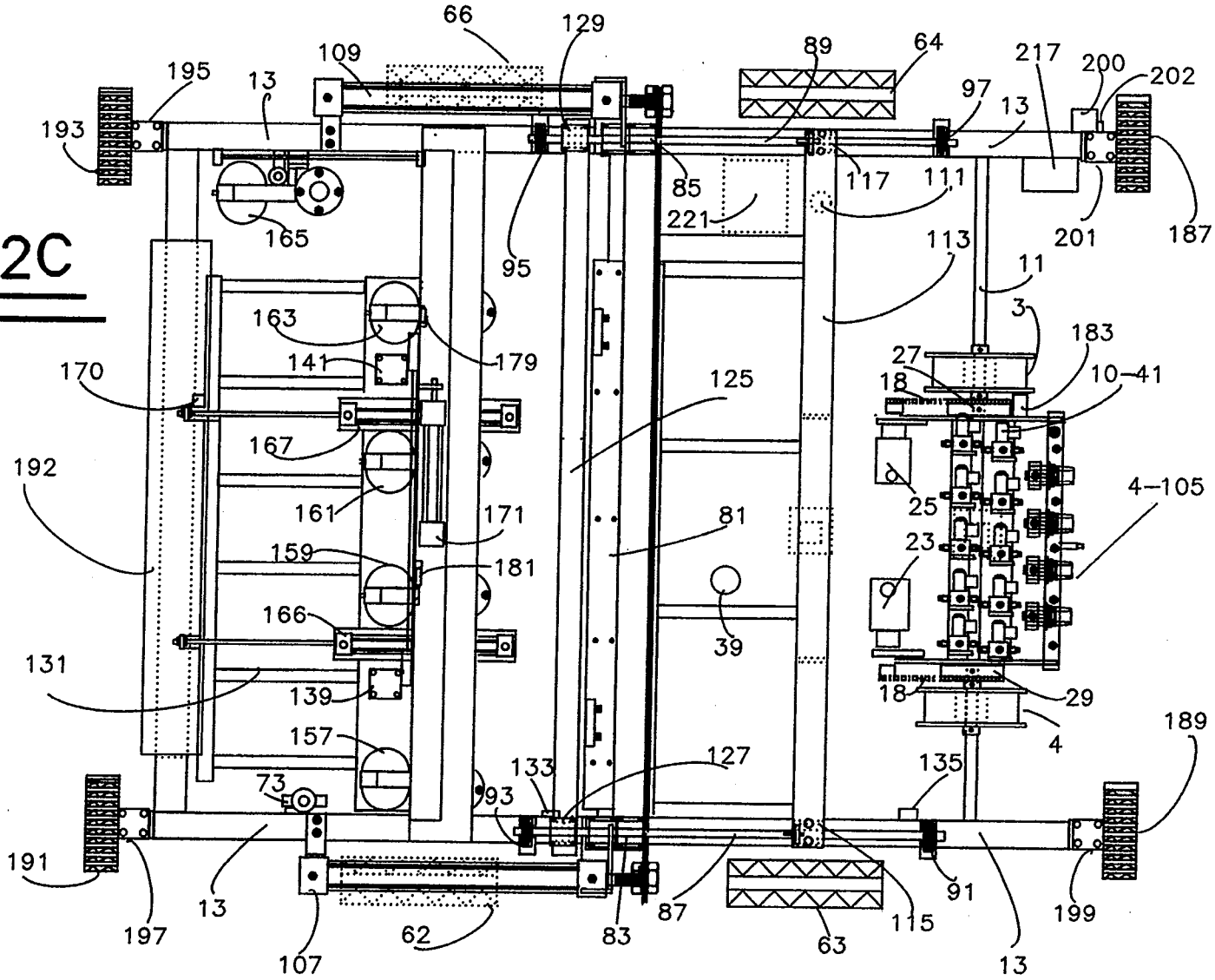

FIG. 2*c* shows top view when the shingle fork moves out from under the shingles.

Figure 2D:
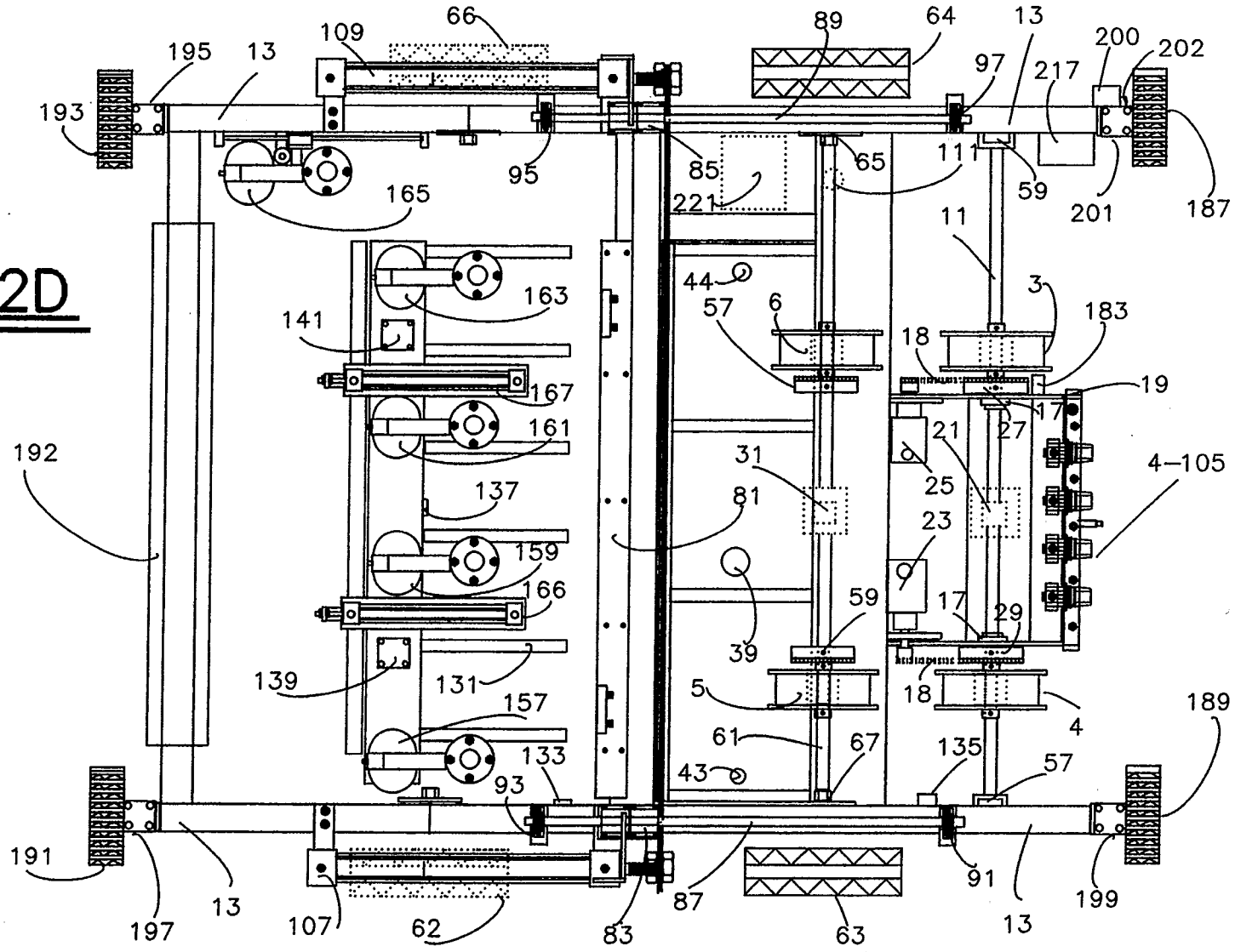

FIG. 2*d* shows top view when the shingle fork returns to the start position

Figure 3:
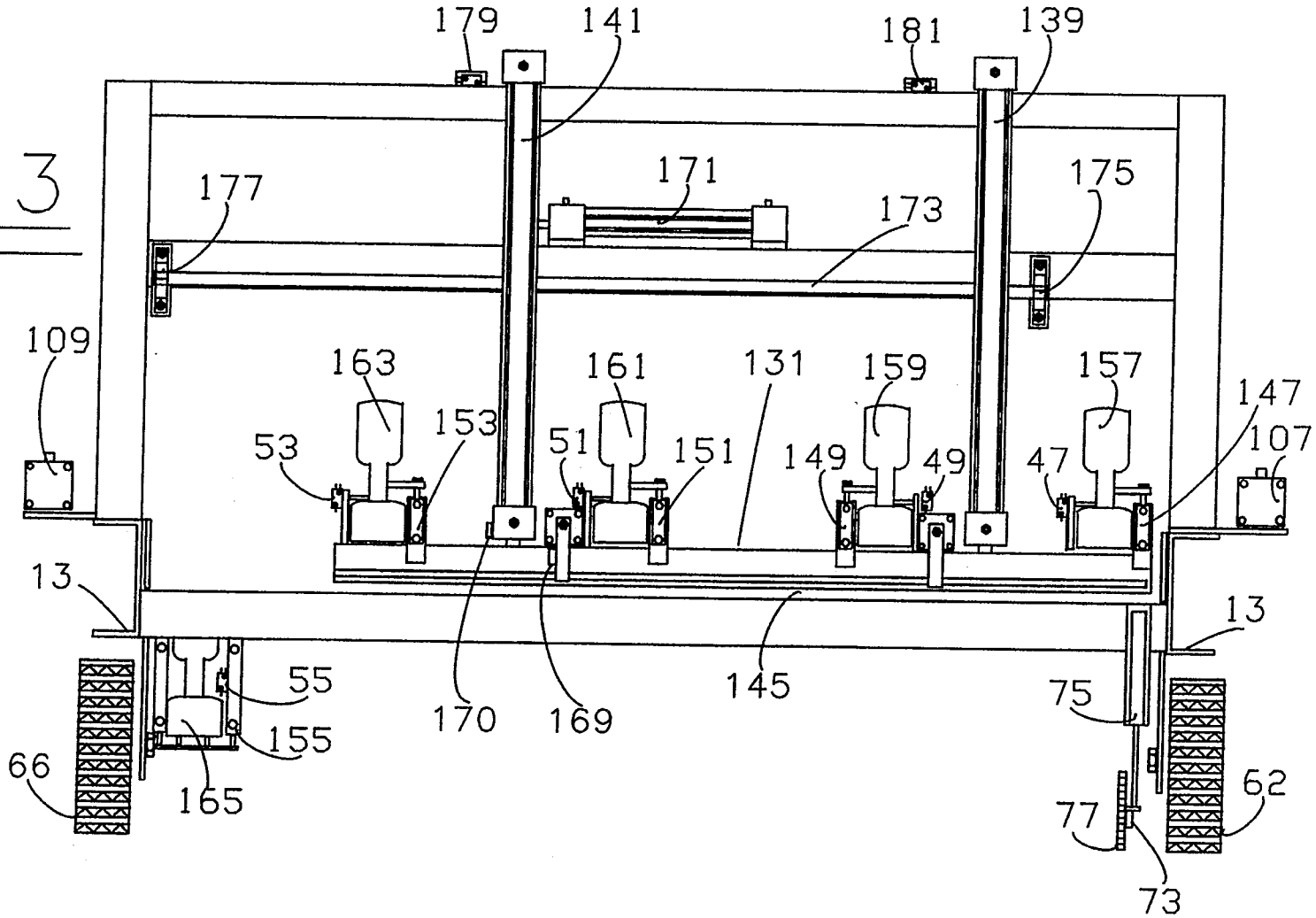

FIG. 3 shows back view of the Automatic Robot Roofer when the shingle forks are ready for a shingle.

Figure 3A:
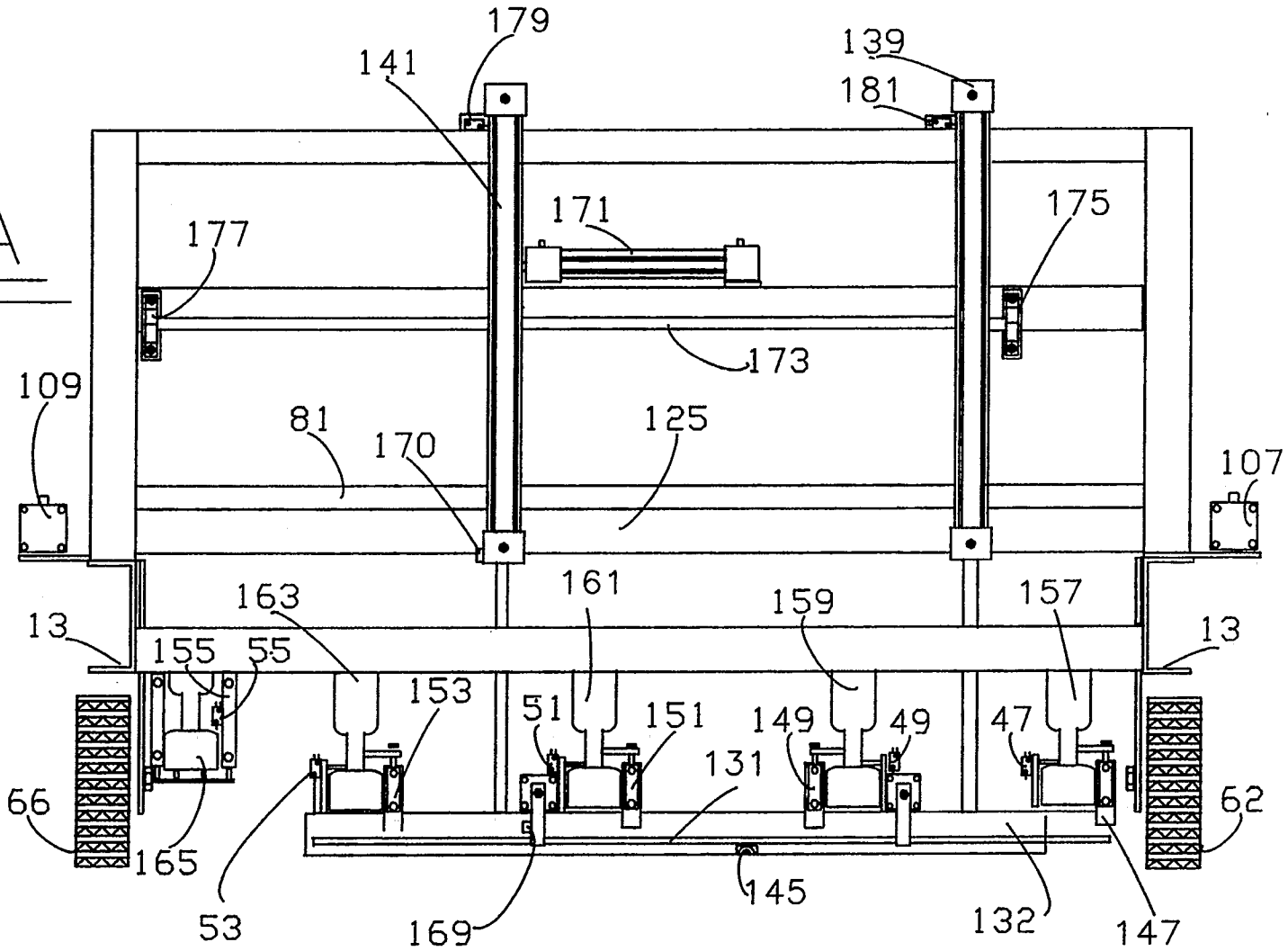

FIG. 3*a* shows back view when shingle forks are in down position.

Figure 3B:
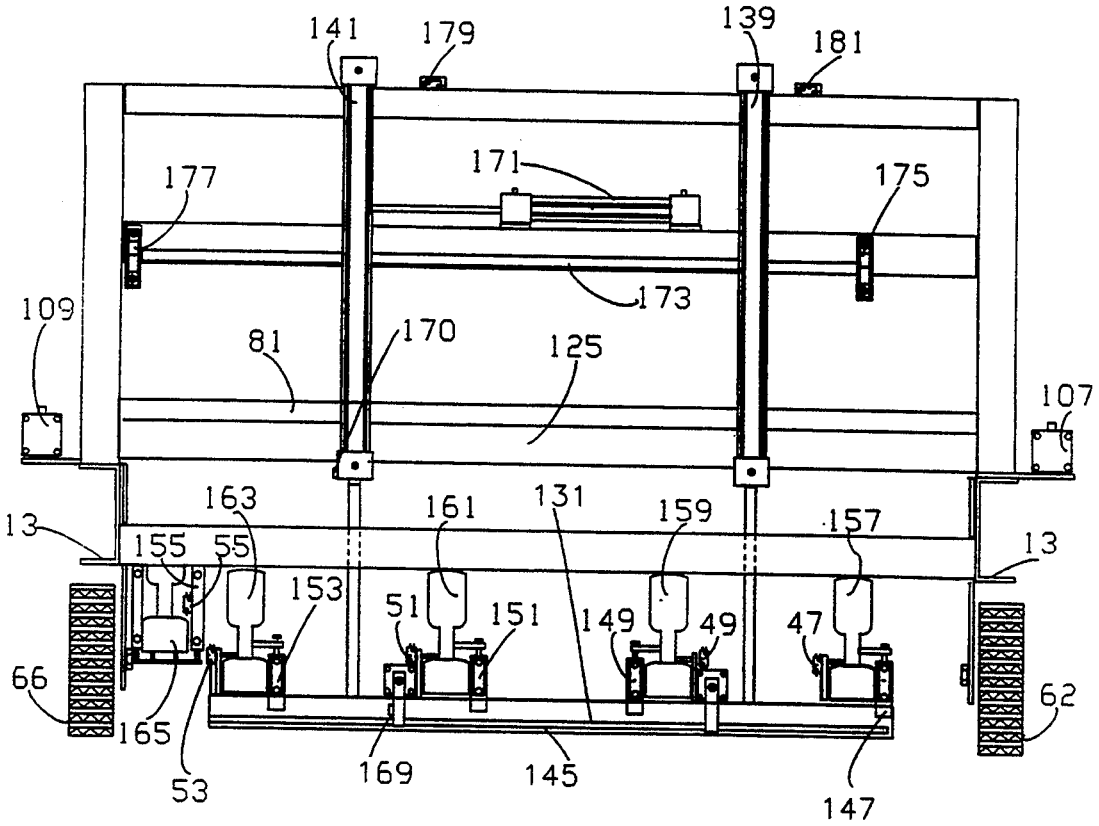

FIG. 3*b* shows back view when the shingle forks have moved left.

Figure 4:
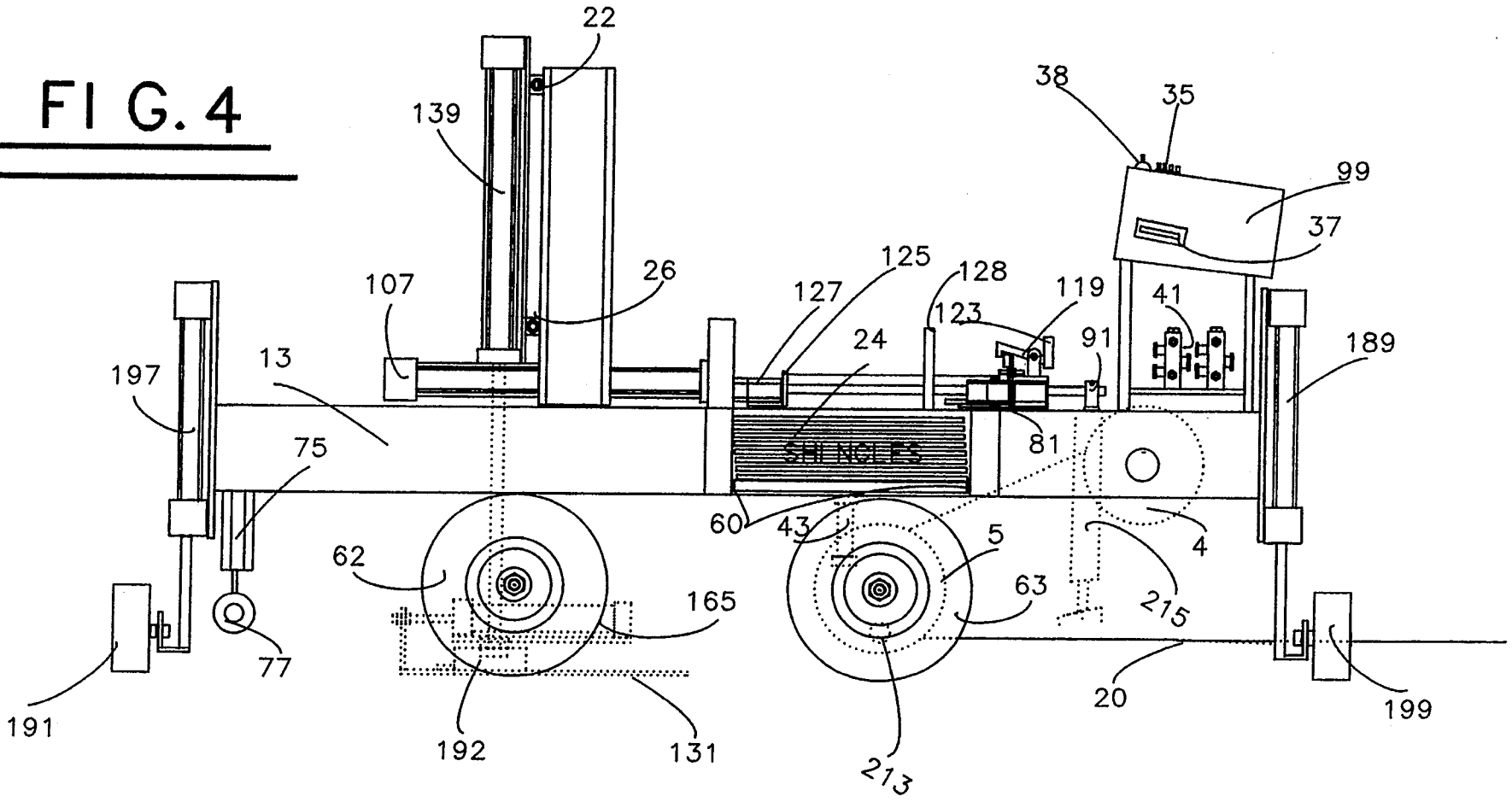

FIG. 4 shows side view of the Automatic Robot Roofer.

Figure 5:
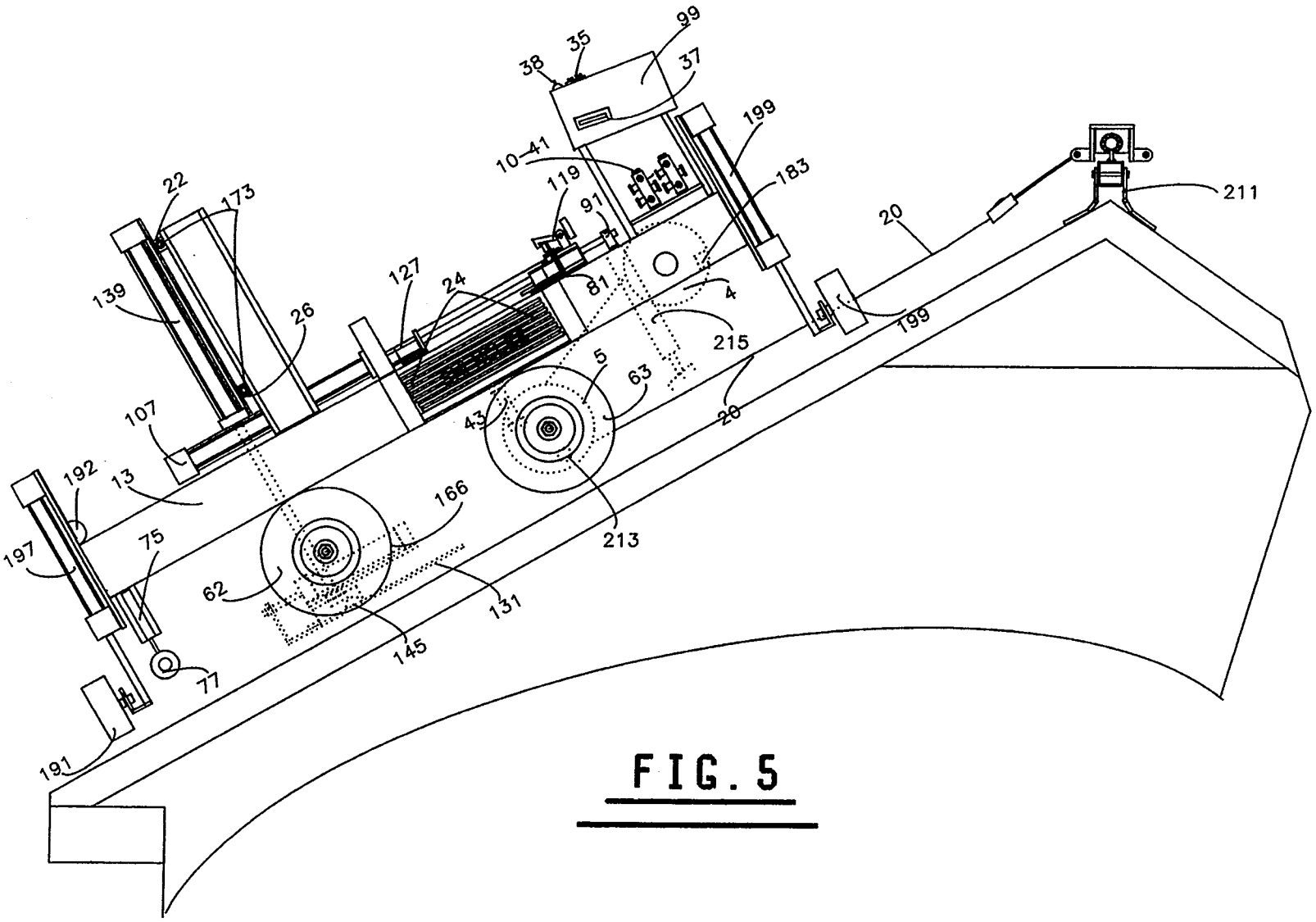

FIG. 5 shows the Automatic Robot Roofer side view hooked up to the linear motion bracket.

Figure 6:
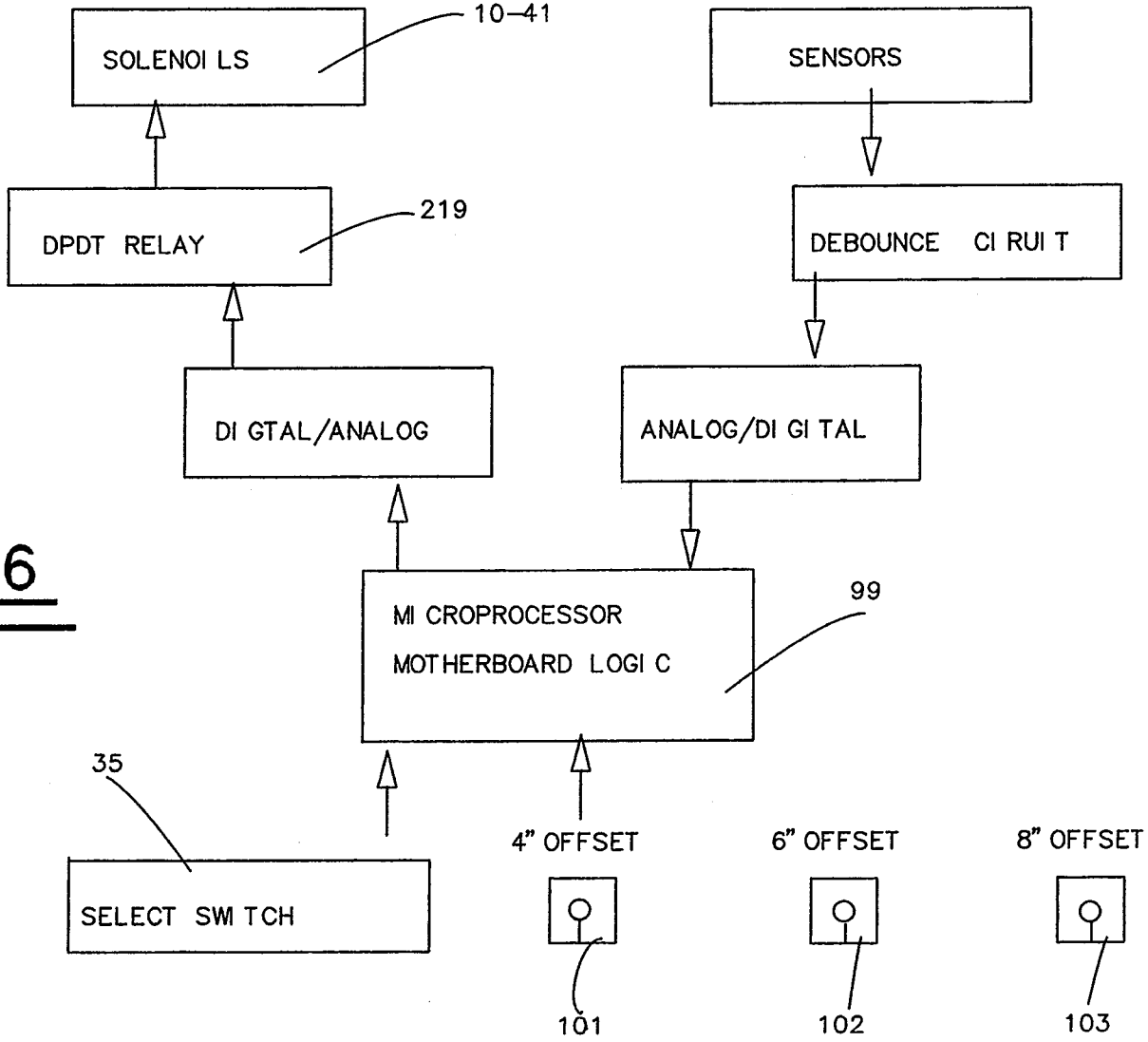

FIG. 6 shows the layout of the control unit.

Figure 7:
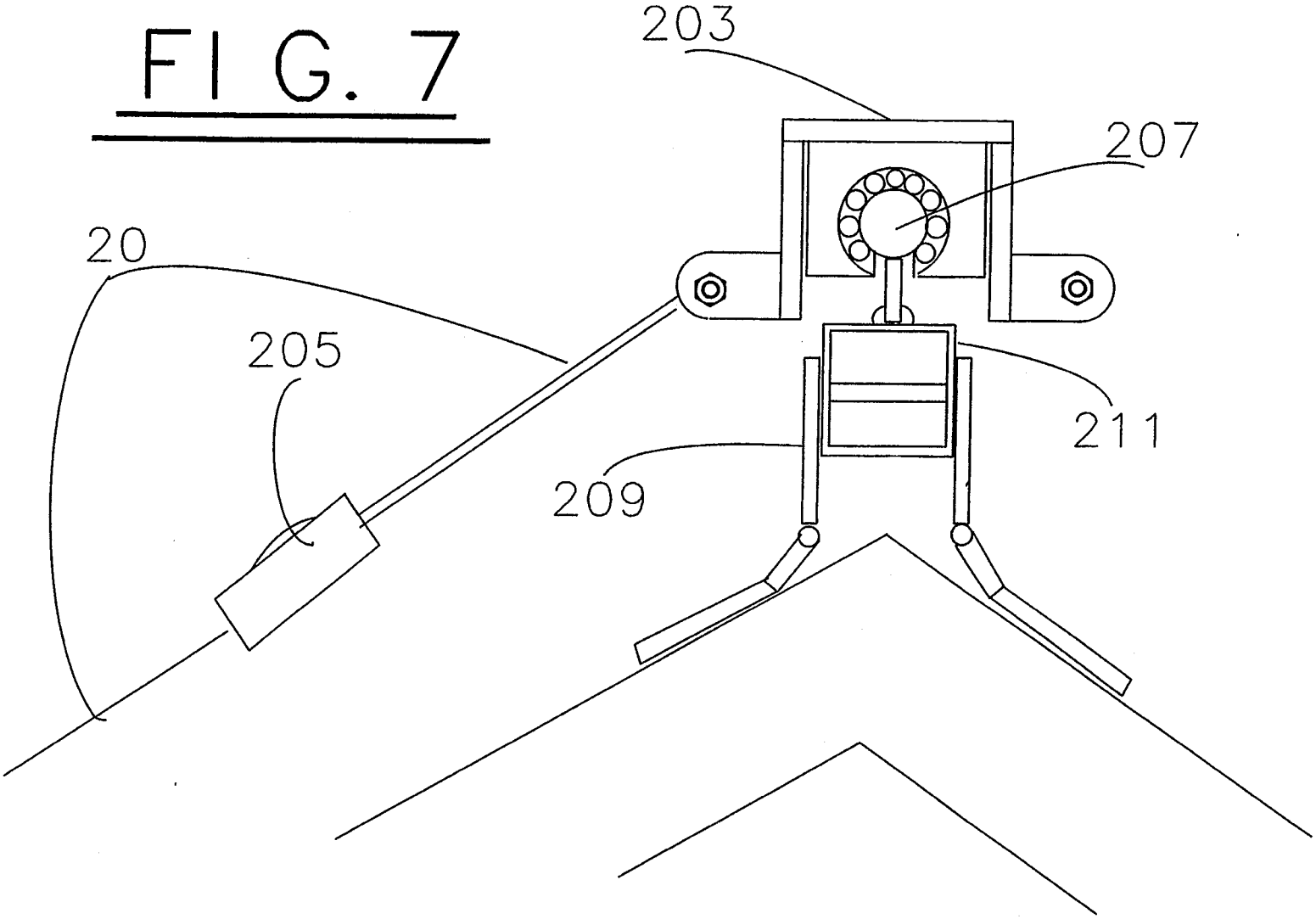

FIG. 7 shows the side view of the linear motion top mounting bracket.

Figure 7A:
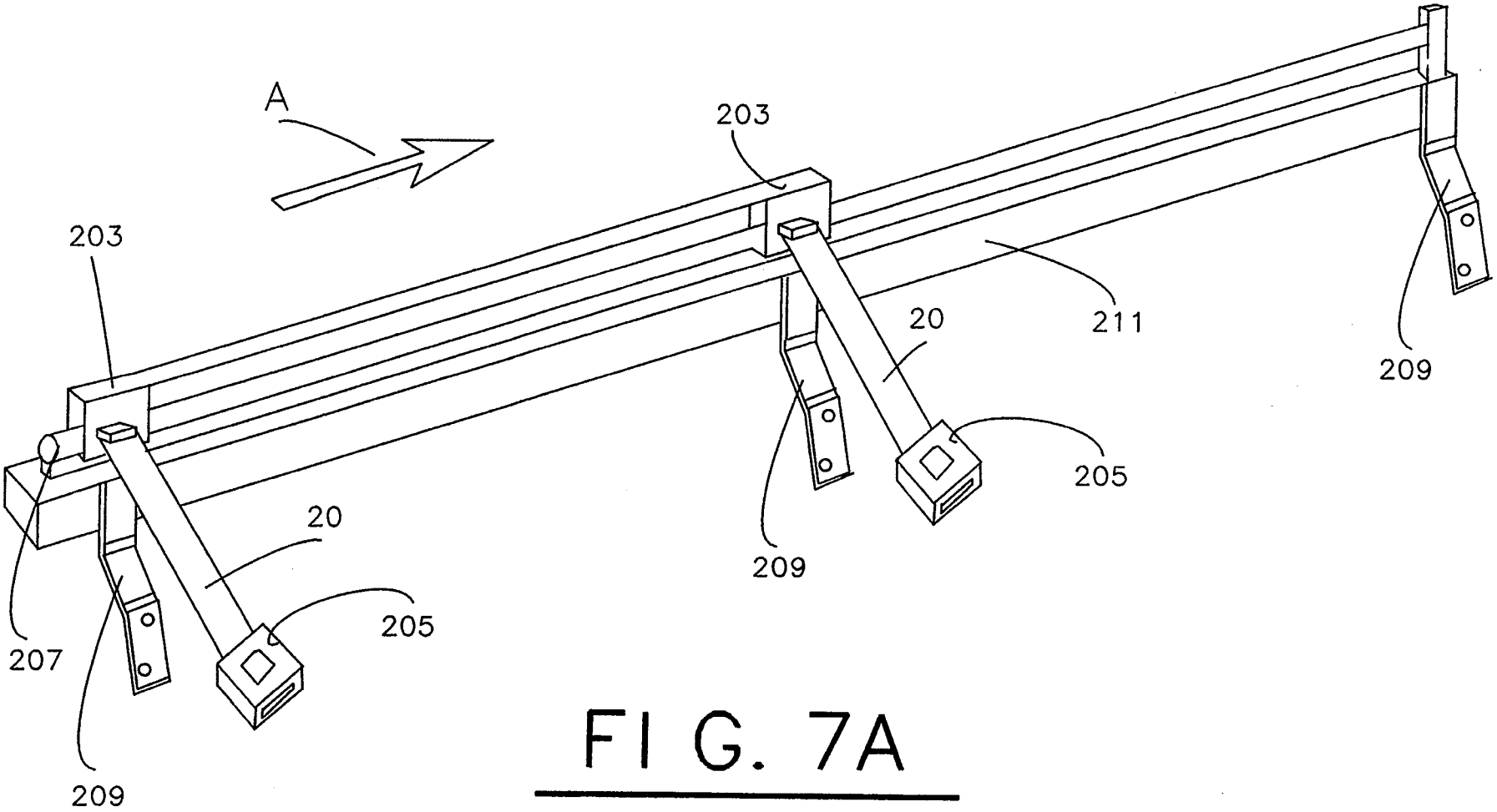

FIG. 7*a* shows a perspective view of the linear motion bracket.

REFERENCE NUMERALS IN DRAWINGS

3,4 drive pulley
5,6 idler pulley
11 drive pulley shaft
13 main frame
15 drive shaft
17 drive bearings
18 drive chains
19 motor frame
20 nylon belt
21 clutch
22 linear motion bearing
23 drive motor
24 hopper
25 drive motor
26 linear motion bearing
27 sprocket clutch
29 sprocket clutch
31 clutch coupling
33 clutch coupling
37 optional disk drive
35 select switch
38 start button
39 photo sensor
41 10 air solenoids
43 hopper air cylinder
44 hopper air cylinder
47,49,51,53,55 gun sensors
57,59 brakes
60 bearings
62,66 idler wheels
63,64 drive sheels
65,67 drive bearings
73 shingle sensor
75 sensor air cylinder
77 guide wheel
81 suffer bar
83,85 linear bearing
87,89 linear bearing shafts
91,93,95,97 shaft supports
99 microprocessor unit
100 4 regulators
107,109 air cylinders
111 pressure sensor
113 pressure bar
115,117 linear bearings
119,121 spring trip
125 hold down bars
127,129 gauge bar linear bearings
131 shingle forks
133,135 suffer sensors
132 fork assembly
137 shingle sensor
139,141 fork air cylinders
143 shingle hold-down air cylinder
145 light sensor
147,149,151,153,155 gun air cylinders
157,159,161,163,165 nail or staple guns
166,167 linear fork cylinders
169,170 fork sensors
171 shift air cylinder
173 linear shaft
175,177 shaft supports
179,181 side shift sensors
183 stop sensor
187,189,191,193 horizontal movement wheels
192 air tank supply
195,197,199,201 lift air cylinders
200 horizontal movement motor
202 safety sensor
203 linear bearing
205 set belt eends
207 linear shaft
209 brackets
211 brace
213 photo sensor
215 stop air cylinder
217 stop air tank
219 relays
221 battery

DESCRIPTION OF PREFERRED EMBODIMENTS

Figure 1:
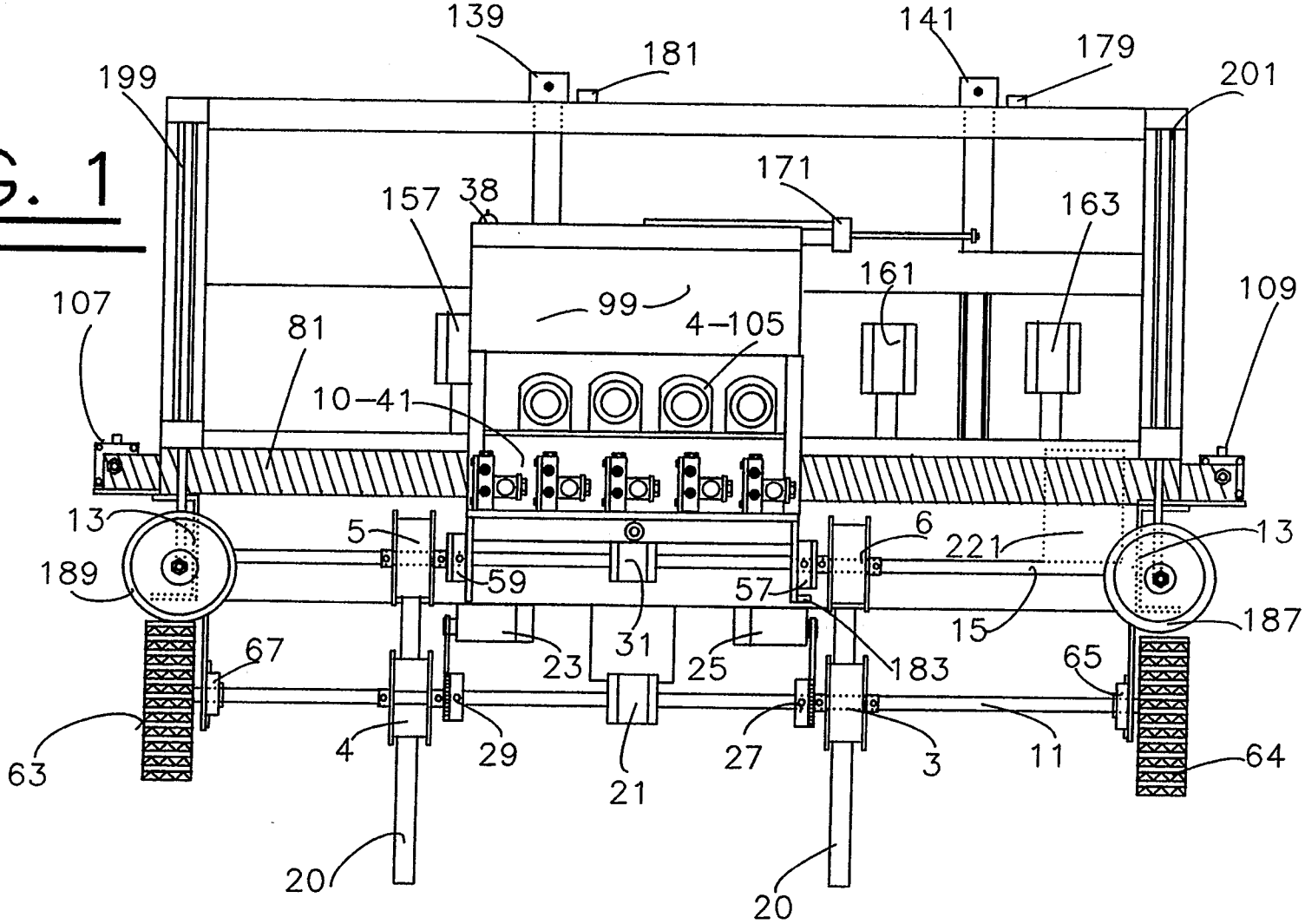
FIG. 1 shows the front view.

Refer to the drawings for a clearer understanding of the Automatic Robot Roofer, FIG. 7 & 7*a* shows the top linear motion brace 211 which is mounted with fasteners through holes in the hinged brackets 209. The linear motion bearings 203 are mounted over a rod 207 and move in a horizontal direction. The support has two seat belt ends 205 attached to the linear motion bearings 203. The seat belt ends hook up to the belt 20 of FIG. 5, but first the linear motion brace 211 needs to be fastened to the roof. As shown in FIG. 4 and 2*d*, the nylon belts 20 are fastened to the pulleys 3 and 4 and are fed over pulleys 5 and 6. The pulleys 3 and 4 are the drive pulleys which are mounted to a horizontal shaft 11. The shaft is mounted to the main frame 13 with flange type bearings 65 & 67. Also, shaft 11 is mounted on the motor frame 19 with drive bearing 17. Shaft 11 has a cupping clutch 21 that provides pulleys 3 and 4 with either positive drive or independent drive. The drive motors 23 and 25 are air driven motors with chains 18 that drive pulleys 3 and 4, when the start up mode or start switch 38 of FIG. 1 & 5 is set. An analog signal from the microprocessor 99 of FIG. 4 and 6, is sent to the relay, 219, using a 12 volt battery supply, FIG. 2-221. Twelve volts are then applied to the clutches 21, 27, 29, and 31 are disengaging the 4 pulleys to release the nylon belts 20 of FIG. 4. This allows the operator to hook the belts of FIG. 4, 20 to the linear motion mounting bar 211 of FIG. 5 and 7*a*.

After setting up the program sequence, either 4", 6" or 8" offsets 101, 102, and 103 of FIG. 6, by either computer program or selection switches 35 of FIG. 4 & 6, the start up switch 38 of FIG. 4 & 5, on the top of the microprocessor unit 99, is turned to the on position. Now the microprocessor 99 will begin the shingling process. However, if the hopper 24 in FIG. 5 has no shingles in it, sensor 39 of FIG. 2 will send an analog signal to the microprocessor 99 for processing, FIG. 6. The microprocessor 99 will send back an analog signal to a relay 219 of FIG. 6 which will then activate one of the solenoid air valves 41 of FIG. 2, and the solenoid 41 will send air pressure to the air cylinder 43 and 44 of FIG. 4. causing the air cylinders 43 and 44 of FIG. 4 to lower the hopper platform 24. The hopper platform is now ready to be loaded with shingles. The hopper platform 24 of FIG. 4 moves vertically by means of bearings, 60 of FIG. 4, which are placed between the mainframe 13 of FIG. 2 & 4 and platform 24 of FIG. 4. The nail or staple guns 157, 159, 161, 163 of FIG. 3 must also be filled before the microprocessor 99 will allow operation to continue. There are sensors mounted on each gun 47, 49, 51, 53, and 55 of FIG. 3 which indicate the supply if nails or staples. When shingles and guns are filled, the key, in FIG. 1 will reset the Automatic Robot Roofer.

The microprocessor 99 of FIG. 6 now will send an analog signal activating the relays 219 of FIG. 6 that engage the clutches 21, 29, and 31 of FIG. 2*d*. At the same time, the relays 219 of FIG. 6 are sending an analog signal to activate the brakes 57 and 59. The brakes are mounted to the drive shaft 15 of FIG. 1 and to the main frame 13. The main drive wheels 63 and 64 of FIG. 1 also are hooked to the shaft 11. Bearings 65 and 67 of FIG. 1 & 2*d* mount the drive shaft 15, to the main frame 13. A clutch coupling 21 also on the shaft 61 of FIG. 2*d* provides for the independent drive of each tire 63 and 64 for the alignment of the Automatic Robot Roofer for proper placement of the shingles.

After clutches and brakes have been set, the Automatic Robot Roofer moves up the roof, the microprocessor 99 FIG. 4 and 6, sends an analog signal to the relay 219 of FIG. 6 which then activates the solenoid air valve 41 of FIG. 2 sending air pressure to the air driven motors 23 and 25 of FIG. 1 & 2*a*. The Automatic Robot Roofer moves up until the sensor 73 of FIG. 2*c*, senses the first shingle. The sensor is mounted on the air cylinder 75 of and wheel 77 of FIG. 3. The air cylinder. 75 is activated on start up from the microprocessor 99 when the sensor sends an analog signal to the microprocessor 99 of FIG. 6 telling it to stop the air motors 23 and 25 of FIG. 2*d*. At the same time, a signal is sent from the microprocessor 99 to engage the brakes 57 and 59 of FIG. 2*d*. Then the shuffle bar 81 is mounted on two linear motion bearings 83 and 85 of FIG. 2 which move in a linear movement towards the back of the Automatic Robot Roofer in FIG. 2*a*.

The bearings 83 and 85 move on mounted shafts 87 and 89 in FIG. 2*d* that are mounted to the main frame 13 with the use of shaft supports 91, 93, 95, and 97. The microprocessor 99 now sends a signal to relay 219 of FIG. 6 which in turn activates one of the solenoid air valves 41 which sends air pressure through regulator 105 to air cylinders 107 and 109 of FIG. 2. This causes the air cylinders to pull the shuffle bar 81 back across the pile of shingles in the hopper 24 as seen in FIG. 2*a*. The air cylinders 43 and 44 as located in FIG. 2*d* and 4 shows cylinders pushing the shingles up in the hopper 24 against the shuffle bar 81 with just the right amount of force which is regulated by the pressure switch 111 of FIG. 2*a*. As the shuffle bar 81 moves it pulls a shingle and pulls pressure switch bar 113 which is also mounted to the linear motion bars 87 and 89 with linear motion bearings 115 and 117 of FIG. 2*a* and there is a spring trip 119 and 121 mounted on the pressure bar 113 as shown in FIG. 4. As the shuffle bar 81 moves, the pressure bar 113 is pulled until the spring trips 119 and 121 are released by the gauge bar 123 as shown in FIG. 4, leaving the pressure bar 113 about 3 inches on the back part of the shingles in the hopper 24. Now the shuffle bar 81 continues to move, pulling the shingle across the pile of shingles. The bar 125 as seen in FIG. 2*a*, is holding down the back part of the shingle pile that is in the hopper 24 which is also mounted to the linear motion bars 87, 89 of FIG. 2. The hold down bar 125 has two linear motion bearings 127 and 129. The shuffle bar 81 pushes the hold down bar 125 off the shingle pile in the hopper 24 and the shingles are now off the hopper 24 of FIG. 2*a*. The shingle has been pushed onto the shingle forks 131 as shown in FIG. 2*a*. Now the shuffle bar 81 has come in contact with sensor 133. The sensor sends an analog signal to the microprocessor 99 of FIG. 6 and the shuffle bar 81 is then extracted taking back with it the hold down bar 125. The bar gauge 128 of FIG. 4 stops the bar 125 about 3 inches over the back of the hopper 24 and the shuffle bar 81 continues on until it pushes the pressure bar 113 back to the starting point and triggers the sensor 135 of FIG. 2 to let the microprocessor 99 of FIG. 6 know that the next shingle is ready to be delivered to the shingle forks 131 as seen in FIG. 2 and 4.

The shingle in the fork 131 of FIG. 2*b* has been pushed against sensor 137 as seen in FIG. 2*a*. Now the analog signal from sensor 137 is sent to the microprocessor 99. The microprocessor 99 sends an analog signal to relay 219 of FIG. 6, which activates one of the solenoids 41 and the air pressure is then sent to the air cylinder shingle hold down 143 of FIG. 2*a*. The shingle hold down 143 is mounted to the shingle forks 131 and is used to hold the shingle in the shingle forks assembly 132 until it is fastened down. At the same time an analog signal is sent to relay 219 which activates another solenoid 41 and the air cylinders 139 and 141 as seen in FIG. 3. The air cylinder 139 and 141 push the shingle forks assembly 132 down to the roof, carrying the shingle with it as shown in FIG. 3*a*.

When the shingle forks 131 touch the roof, a photo sensor 145 of FIG. 3 is mounted on the bottom of the shingle fork assembly 132 of FIG. 3*a*, sends a signal to the microprocessor 99 of FIG. 6 letting it know that it is time to fasten the shingle in place. The microprocessor 99 sends an analog signal to relay 219 of FIG. 6 which activates one of the solenoids 41 and then the air pressure is sent to the nail or staple gun air cylinders 147, 149, 151, and 153. The nail or staple gun air cylinders 147, 149, 151, 153, 155 as shown in FIG. 3*a* are mounted to the shingle fork assembly supports 132. The air cylinder rods 147, 149, 151, 153 and 155 are mounted to the nail or staple guns 157, 159, 161, 163, and 165 as seen in FIG. 3. The guns pivot on the shingle fork support 132 and the air cylinders 147, 149, 151, 153, and 155 all move nail guns down. Sensors 47, 49, 51, 53 and 55 send an analog signal to the microprocessor 99 of FIG. 6 telling the microprocessor that all guns have fired and to pull the shingle forks 137 of FIG. *2c* from under the shingle.

The microprocessor 99 sends an analog signal to the relay 219 FIG. 6 which activates the solenoid 41 and then the air pressure is sent to the fork air cylinders 166 and 167 as seen in FIG. *2c*. The shingle forks 131 are pushed out from under the shingles when the air pressure in the fork cylinders is sent. As soon as the forks are out from under the shingle, sensor 169 as shown in FIG. 3 lets the microprocessor 99 know to lift the shingle fork assembly 132 so it can be ready for the next shingle to be loaded.

When the forks start up the light sensor 145 also signals the microprocessor 99 to start the movement of Automatic Robot Roofer sending an analog signal to the relay 219 in FIG. 6 and sending air pressure to the motors 23 and 25 to start moving the Automatic Robot Roofer up the roof to set its next shingle, stopping when the sensor 73 of FIG. 3 comes to the shingle that was previously laid and then stopping the Automatic Robot Roofer. The microprocessor 99 will then start the process all over again. However, this time when the shingle forks 132 touch the roof with a shingle, the photo sensor 145 of FIG. *2d* will let the microprocessor know that this is the next shingle and the shingle forks 132 as seen in FIG. *3b* will move over to the left side, looking from the back of FIG. *3b*. An analog signal will be sent to the relay 219 of FIG. 6 which activates a solenoid 41 and air pressure will be sent to the side shift air cylinder 171 as seen in FIG. *2b* and *3b*. The air cylinder 171 is mounted to the frame. The shingle fork assembly 132 is suspended from 2 air cylinders 139 and 141 which are mounted to two linear motion bars 173 as seen in FIG. *3b*. The bar 173 is mounted to the frame with two support blocks 175 and 177 and the air cylinders 139 and 141 are mounted to the bar 173 with linear motion bearings 22 and 26 all seen in FIG. 3. The side cylinder 171 pushes the whole shuffle fork assembly 132 to the left 4, 6, or 8 inches depending on which switch or optional program disk 101, 102, 103 of FIG. 6 was used on start up. Sensor 179 will engage when the side cylinder 171 moves over to set the shingle on an offset of FIG. *3b*. The sensor sends a signal to the microprocessor and the microprocessor 99 now sends a signal to the relay 219 of FIG. 6 which activates one of the solenoids 41 o FIG. *2b* sending air pressure to the designated nail or staple guns to fasten the shingle down. Nail or staple guns 157, 159, 161, and 163 all fasten the shingle in place this time.

Sensors 47, 49, 51, 53 and 55 of FIG. *3b* let the microprocessor 99 know that the shingle has been fasten and to pull the forks 131 of FIG. *2c* out from under the shingle. The sensor 170 as shown in FIG. *2c*. tells the microprocessor 99 now to send an analog signal to the relay 219 of FIG. 6 and then to activate one of the solenoids 41 and air pressure is then sent to the side shift air cylinder 171 of FIG. *3b* and the shingle fork assembly 132 is returned, ready for the next shingle to start over again.

Again, the process continues until the Automatic Robot Roofer reaches the top of the roof and then a sensor 183 of FIG. 2 sends a signal to the microprocessor letting the microprocessor 99 of FIG. 6 know it is time to move the Automatic Robot Roofer over approximately 3 feet. The microprocessor 99 sends an analog signal to the relay 219 of FIG. 6 which activates one of the solenoids 41 and air pressure is then sent to all four side lift tires. Air cylinders 195, 197, 199, and 201 as seen in FIG. 2, 4 and 5 are mounted to the main frame 13 and four tires 187, 189, 191, and 193 are mounted to the air cylinder. When the air pressure lifts the Automatic Robot Roofer off its main tires 63, 64, 62 and 66 the analog signal is sent to the relay 219 of FIG. 6 sending air pressure to the air motor 200 of FIG. 2 moving the Automatic Robot Roofer over to the right looking from the back. After moving, a signal from sensor 202 stops motor 200 and tells the microprocessor 99 to send an analog signal to relay 219 of FIG. 6 to activate and the air cylinders 195, 197, 199, and 201 which lift the tires 187, 189, 191, 193, placing the main tires back on the roof. The Automatic Robot Roofer then starts down the roof. The microprocessor 99 allows it to travel at a safe speed back down. Photo sensor 213 of FIG. 4 and 5 senses the speed and measures the distance of the return, and when it is near the bottom, sensor 73 touches the bottom edge of the roof of FIG. 5 and an analog signal is then sent back to the microprocessor 99 of FIG. 6 and the microprocessor sends a signal to the brakes 57 and 59 of FIG. *2d* to stop and to start the shingle process again. If the photo sensor 213 of FIG. 5 senses that the Automatic Robot Roofer is out of control the safety air cylinder 215 of FIG. *2d* and 5 will activate an independent air supply tank 217 on the Automatic Robot Roofer. The cylinder will drive a pointed end into the roof holding the Automatic Robot Roofer to the roof until all repairs are completed.

What I claim:

1. An apparatus for automatically applying shingles to a roof, said apparatus comprising:

(a) a primary main frame comprising a set of idler wheels and a first set of drive wheels mounted on said primary main frame for vertical rolling movement;

a second set of drive wheels mounted on said primary main frame for horizontal rolling movement;

means to engage said set of idler wheels and said first set of drive wheels with said roof to permit vertical movement of said primary main frame thereover;

means to engage said second set of drive wheels with said roof for horizontal movement of said primary main frame thereover;

a hopper for holding a stacked supply of shingles therein;

means for delivering the top shingle from said stacked supply of shingles from the hopper to the surface of the roof;

means for fastening said shingles to said roof, said means for fastening including a supply of fasteners;

means for sensing the supply of shingles in said hopper;

means for sensing the supply of fasteners in said fastening means;

means for sensing the distance traveled by said primary main frame as it moves vertically over said roof;

means for sensing the distance traveled by said primary main frame as it moves horizontally over said roof;

means for sensing the placement of said top shingle relative to said roof surface after delivery thereto by said delivering means; and a microprocessing system for controlling each engaging means and all movements of said primary main frame over said roof based upon conditions sensed by each sensing means; and (b) means detachably connected to said roof and fastened to said primary main frame for supporting said primary main frame as it moves over said roof;

wherein, during a cycle of operation of said apparatus, said microprocessing system responds to signals generated by each sensing means to control said primary main frame such that said primary main frame starts at the bottom of said roof, applies shingles one at a time to said roof as said primary main frame moves vertically upward towards the top of said roof, stops at the top of said roof, moves horizontally to the position at which the next vertical row of shingles is to be applied to said roof, moves vertically downward towards the bottom of said roof, and stops at the bottom of said roof in preparation for applying the next vertical row of shingles thereto.

2. The apparatus as claimed in claim 1, further comprising:

braking means to slow said primary main frame as it moves over said roof;

means for sensing the speed of said primary main frame as it moves downwardly from the top of said roof; and emergency stopping means for stopping downward movement of said primary main frame if said speed sensing means senses a speed which exceeds a predetermined limit.

3. The apparatus as claimed in claim 1, wherein said delivering means further comprises:

a fork movable between said hopper and said roof surface by a plurality of air cylinders;

a shuffle bar adapted to move across said stacked supply of shingles to lift the top shingle from said stack and deliver said top shingle to said fork; and means for holding said top shingle on said fork to ensure proper placement thereon.

4. The apparatus as claimed in claim 1, wherein said fastening means is mounted on said fork, and said fastening means comprises a plurality of nail guns or staple guns.

5. The apparatus as claimed in claim 1, wherein said supporting means comprises:

a rectangular aluminum bar supported by brackets which are fastened to the top of said roof;

a rod fastened to said bar for supporting linear motion bearings which are horizontally movable along said rod;

a plurality of belts attached at one end to said primary main frame and at another end to a respective one of said linear motion bearings.

* * * * *